US005414993A

United States Patent [19]

Kon

[11] Patent Number: 5,414,993

[45] Date of Patent: May 16, 1995

[54] EXHAUST PORT LINER AND SEAL ASSEMBLY

[75] Inventor: Tony S. Kon, Peoria, Ill.

[73] Assignee: Caterpillar Inc., Peoria, Ill.

[21] Appl. No.: 171,939

[22] Filed: Dec. 22, 1993

[51] Int. Cl.[6] ..... F01N 3/20

[52] U.S. Cl. ..... 60/272; 60/322; 123/193.5

[58] Field of Search ..... 60/272, 282, 305, 321, 60/322, 323, 324; 123/193.3, 193.5

[56] References Cited

U.S. PATENT DOCUMENTS

| | | | |
|---|---|---|---|
| 2,295,436 | 9/1942 | Tendler | 60/305 |
| 4,089,164 | 5/1978 | Iwasa | 60/282 |
| 4,117,672 | 10/1978 | Yamazaki | 60/282 |
| 4,168,610 | 9/1979 | Engquist | 60/282 |

*Primary Examiner*—Ira S. Lazarus
*Assistant Examiner*—Daniel J. O'Connor
*Attorney, Agent, or Firm*—Diana L. Charlton

[57] ABSTRACT

The design and construction of past exhaust port liners with heat insulation capabilities have become more complicated and costly or have incurred increased associated costs for utilizing the invention. The present invention overcomes these problems by utilizing a simple exhaust port liner and seal assembly for an internal combustion engine. The exhaust port liner and seal assembly includes a member which has a flange and a body extending from the flange. The flange is mounted between a cylinder head and an exhaust manifold and the body extends into an exhaust port. The member terminates at an annular lip in close proximity to a cylindrical wall of the exhaust port to form an enclosed space between the lip and the flange. A sealing means surrounds the flange between the cylinder head and the exhaust manifold to seal exhaust gas within the exhaust port before entering the exhaust manifold. The enclosed space allows an air layer to form between the body of the member and the cylinder head to act as an insulating medium. The insulating air layer in conjunction with the limited physical contact between the member and the cylinder head decreases the rate of heat loss from the exhaust gas. The ability to decrease the rate of heat loss increases engine efficiency.

3 Claims, 1 Drawing Sheet

EXHAUST PORT LINER AND SEAL ASSEMBLY

TECHNICAL FIELD

This invention relates generally to an exhaust port liner and seal assembly for use in an internal combustion engine and more particularly to the use of the exhaust port liner and seal assembly to reduce heat rejection including sealing between a cylinder head and an exhaust manifold.

BACKGROUND ART

Present day engine components must be manufactured more simply at significantly reduced costs while achieving superior results in order for engine manufacturers to remain competitive. Unfortunately, exhaust port liners that have produced superior heat insulation capabilities have become more complicated and costly or have incurred increased associated costs for utilizing the invention.

Some exhaust port liners appear to be manufactured more simply, but, assembly requirements have become more complicated to accommodate the new design. Typically, with this design, the cylinder head is machined to include a counterbore for seating the exhaust port liner thereby increasing overall costs of the design.

The goal of one exhaust port liner disclosed in U.S. Pat. No. 4,096,690 by James J. Florek on Jun. 27, 1978 was to provide a heat resistant liner for improving emissions. The liner allows secondary air to enter its interior through apertures partially punched out of the liner body. The emission content, and particularly the hydrocarbon content of the exhaust gases is reduced by secondary chemical conversion within the confines of the exhaust passage of the liner and by appropriate control of the influx of secondary air preferably during the exhaust cycle. The exhaust port liner has an annular flange mounted against a surface which is the sole engagement between the cast cylinder head and the liner. It appears that the flange is used as a seal between the cylinder head and the exhaust manifold. The use of the flange as an exhaust seal requires precise machining of the flange and the cylinder head in order to maintain a desirable surface finish for proper sealing. The precise machining increases the costs associated with the exhaust port liner design. Additionally, the flange must carry all of the clamping load between the cylinder head and the exhaust manifold which could lead to premature failure of the seal damaging the effectiveness of the exhaust port liner.

The present invention is directed to overcoming the problems as set forth above.

DISCLOSURE OF THE INVENTION

In one aspect of the present invention, an exhaust port liner and seal assembly is provided for an internal combustion engine. The internal combustion engine has a cylinder block and a cylinder head. The cylinder head includes an outer mounting surface and an inner mounting surface attached to the cylinder block and defines with the cylinder head at least one variable volume combustion chamber. An exhaust manifold is releasably connected to the cylinder head and has a mounting surface. An exhaust port is defined within the cylinder head and extends, in fluid connecting relationship, between the combustion chamber and the exhaust manifold. At least a portion of the exhaust port has a substantially cylindrical wall. A cylindrical member with a radial outwardly extending annular flange is mounted between the outer mounting surface of the cylinder head and the mounting surface of the exhaust manifold. The member has a body which extends from the flange and into the exhaust port a predetermined distance. A means is disposed between the outer mounting surface of the cylinder head and the mounting surface of the exhaust manifold. The means is in surrounding relation to the flange for sealing between the cylinder head and the exhaust manifold.

The present invention, through the use of a cylindrical annular member and sealing means between a cylinder head and an exhaust manifold provide a simple and economical method to limit heat rejection for greater engine efficiency.

BEST MODE FOR CARRYING OUT THE INVENTION

Figure 1:
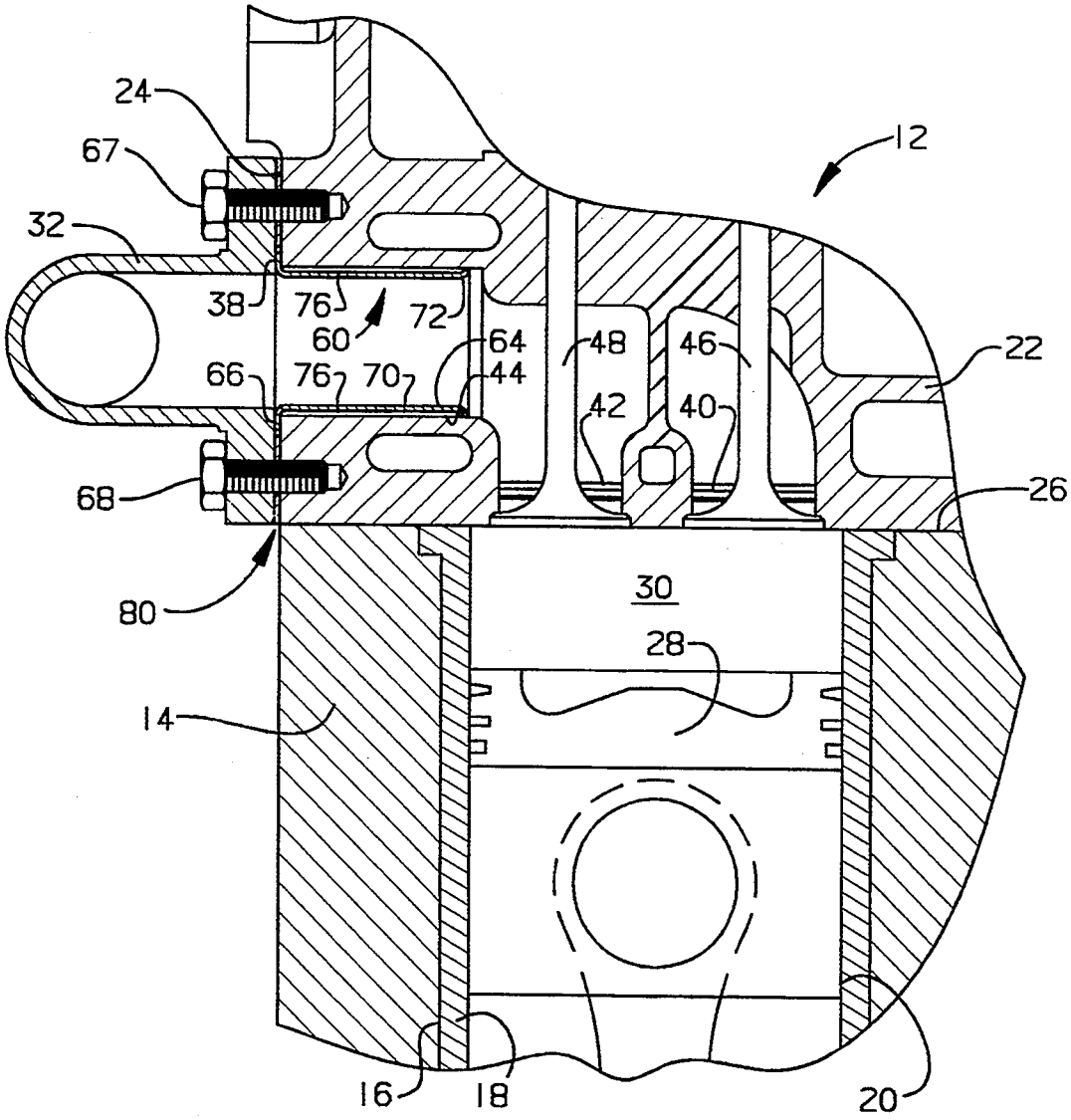
FIG. 1 is partial section view of an internal combustion engine embodying the present invention.

An internal combustion engine 12 having a cylinder block 14 defining a bore 16 is shown in FIG. 1. The bore 16 has a cylinder liner 18 disposed therein. The cylinder liner 18 defines a cylinder bore 20 and a cylinder head 22 has an outer mounting surface 24 and an inner mounting surface 26 which attaches to the cylinder block 14 in closing relation to the cylinder bore 20. A piston 28 is reciprocally mounted in the cylinder bore 20 and defines with the cylinder head 22 a variable volume combustion chamber 30. An exhaust manifold 32 is releasably connected to the cylinder head 22 and has a mounting surface 38. An intake port 40 and exhaust port 42 are formed in the cylinder head 22. At least a portion of the exhaust port 42 has a substantially cylindrical wall 44 extending between the combustion chamber 30 and the exhaust manifold 32 to fluidly connect them. An intake valve 46 and exhaust valve 48 having a normally closed position and an open position are disposed within the intake port and exhaust port 40,42, respectively. The intake port 40 fluidly communicates intake air to the combustion chamber 30 during an intake cycle of the engine 12. The exhaust port 42 fluidly communicates exhaust gases out of the combustion chamber 30 during an exhaust stroke of the engine 12. A turbocharger (not shown) is connected to the exhaust port 42 and to the intake port 40 between the combustion chamber 30 and the intake air.

An exhaust port liner and seal assembly 60 is shown in detail in FIG. 1. The exhaust port liner and seal assembly 60 includes a cylindrical member 64. The member 64 is made from a heat resistant material and has a radial outwardly extending annular flange 66 mounted between the outer mounting surface 24 of the cylinder head 22 and the mounting surface 38 of the exhaust manifold 32 by a plurality of bolts, two of which are shown at 67 and 68. The flange 66 has a predetermined thickness. The member 64 has an impervious body 70 extending from the flange 66 and into the exhaust port 42 a predetermined distance. The body 70 is spaced a predetermined distance away from the cylindrical wall 44 of the exhaust port 42. The body 70 terminates at an outwardly extending annular lip 72 which is in close proximity to the cylindrical wall 44 so that a substantially enclosed space 76 is formed between the member 64 and the cylinder head 22. The lip 72, the flange 66, and the body 70 may be integrally cast as a single piece or may be manufactured as separate pieces or a combination of a casting and manufacturing process.

A sealing means 80, such as a laminated gasket, is disposed between the outer mounting surface 24 of the cylinder head 22 and the mounting surface 38 of the exhaust manifold 32. The sealing means 80 surrounds the flange 66 so that exhaust gases exiting the combustion chamber 30 are contained within the exhaust port 42 and the exhaust manifold 32. The sealing means 80 has a predetermined thickness greater than or equal to the thickness of the flange 66. It should be understood that any suitable type of sealing material may be used between the cylinder head 22 and the exhaust manifold 32.

INDUSTRIAL APPLICABILITY

In use, high temperature exhaust gas generated during combustion is released during the exhaust stroke of the internal combustion engine 12. The exhaust gas is communicated from the combustion chamber 30 and into the exhaust port 42 when the exhaust valve 48 is in the open position. It is important that heat produced from the high temperature exhaust gas be retained within the exhaust port 42 before entering the exhaust manifold 32 so that more thermal energy can be supplied to the turbocharger (not shown) for greater engine efficiency.

The enclosed space 76 allows an air layer to form between the body 70 of the member 64 and the cylinder head 22 to act as an insulating medium. The enclosed space may also be filled with an insulating material to provide a similar function. The insulating air layer or insulating material in conjunction with the limited physical contact between the member 64 and the cylinder head 22 decreases the rate of heat loss from the exhaust gas passing from the combustion chamber 30 into the exhaust manifold 32. The decreased rate of heat loss retains thermal energy in the exhaust gas for driving the turbocharger (not shown) at a faster rate which increases incoming air pressure for increased engine efficiency. Furthermore, less thermal energy is transferred to the engine cooling system (not shown) resulting in higher cooling efficiency. The lip 72 is maintained in close proximity to the cylindrical wall 44 to protect the enclosed space 76 from exhaust soot debris which may be present in the exhaust port 42.

The flange 66 retains the member 64 within the exhaust port 42 when it is clamped between the cylinder head 22 and the exhaust manifold 32. A gasket 80 of any suitable type surrounds the flange 66 to seal the exhaust gas within the exhaust port 42. Because the gasket 80 has a thickness greater than or equal to the thickness of the flange 66, it acts as a seal. The flange 66, therefore, does not need to be precisely machined for a surface finish capable of sealing between the cylinder head 22 and the exhaust manifold 32. This allows the member 64 to be manufactured at reduced costs. The gasket 80 also helps apportion the clamping load between the member 64 and the gasket 80 which increases the life of the member 64 and the efficiency of the seal.

In view of the above, it is apparent that the present invention provides an improved means to limit heat rejection. The present invention utilizes a cylindrical annular member and sealing means between a cylinder head and an exhaust manifold to provide a simple and economical method to limit heat rejection for greater engine efficiency.

I claim:

1. In an exhaust port liner and seal assembly for an internal combustion engine having a cylinder block, a cylinder head having an outer mounting surface and an inner mounting surface attached to the cylinder block and defining with the cylinder head at least one variable volume combustion chamber, an exhaust manifold releasably connected to the cylinder head and having a mounting surface, and an exhaust port defined within the cylinder head and extending, in fluid connecting relationship, between the combustion chamber and the exhaust manifold, the improvement comprising:

a cylindrical member having a radial outwardly extending annular flange clamped between the outer mounting surface of the cylinder head and the mounting surface of the exhaust manifold, the member having an impervious body extending from the flange and disposed within the exhaust port and the flange having a first predetermined thickness; and a gasket clamped between the outer mounting surface of the cylinder head and the mounting surface of the exhaust manifold in surrounding relation to the flange, said gasket having a second predetermined thickness greater than said first predetermined thickness to seal between the cylinder head and the exhaust manifold and apportion the clamp load between the cylindrical member and the gasket.

2. The exhaust port liner and sealing assembly of claim 1, wherein at least a portion of the exhaust port has a substantially cylindrical wall, the body being spaced a predetermined distance away from the cylindrical wall.

3. The exhaust port liner and sealing assembly of claim 2, wherein the body terminates at an outwardly extending annular lip in close proximity with the cylindrical wall to define a substantially enclosed space between the member and the cylinder head.

* * * * *